United States Patent [19]

Prasad

[11] Patent Number: 4,576,789

[45] Date of Patent: Mar. 18, 1986

[54] GRAIN-REFINED GOLD-FREE DENTAL ALLOYS FOR PORCELAIN-FUSED-TO-METAL RESTORATIONS

[75] Inventor: Arun Prasad, Cheshire, Conn.

[73] Assignee: Jeneric Industries, Inc., Wallingford, Conn.

[21] Appl. No.: 685,914

[22] Filed: Dec. 26, 1984

Related U.S. Application Data

[63] Continuation-in-part of Ser. No. 570,628, Jan. 13, 1984, abandoned, which is a continuation-in-part of Ser. No. 554,721, Nov. 17, 1983, abandoned, which is a continuation of Ser. No. 458,993, Jan. 18, 1983, abandoned, which is a continuation-in-part of Ser. No. 400,481, Jul. 21, 1982, Pat. No. 4,419,325.

[51] Int. Cl.[4] ..... C22C 5/04

[52] U.S. Cl. ..... 420/464; 420/463; 433/207; 433/222.1

[58] Field of Search ..... 420/463, 464, 587, 465; 433/207, 222

[56] References Cited

U.S. PATENT DOCUMENTS

| | | | |
|---|---|---|---|
| 4,201,577 | 5/1980 | Ingersoll et al. | 420/587 |
| 4,387,072 | 6/1983 | Schaffer | 420/463 |
| 4,451,639 | 5/1984 | Prasad | 420/464 |

FOREIGN PATENT DOCUMENTS

| | | | |
|---|---|---|---|
| 0082655 | 3/1980 | Japan | 420/463 |

*Primary Examiner*—Peter K. Skiff
*Assistant Examiner*—S. Kastler
*Attorney, Agent, or Firm*—Kramer and Brufsky

[57] ABSTRACT

Grain refined palladium-based dental alloys contain about 70–85 weight percent palladium, 7–15 weight percent copper, 2–8 weight percent gallium, 2–15 weight percent indium, 0.2–3.0 weight percent rhenium or ruthenium and an effective amount of boron up to about 0.15% which eliminates the formation of bubbles in porcelain during the porcelain firing process. In addition, there can be an effective amount of zinc up to about 0.5 weight percent. Alternately, in lieu of zinc, the boron is added in the form of calcium boride.

16 Claims, 3 Drawing Figures

GRAIN-REFINED GOLD-FREE DENTAL ALLOYS FOR PORCELAIN-FUSED-TO-METAL RESTORATIONS

CROSS-REFERENCE TO RELATED APPLICATIONS

This is a continuation-in-part of copending application Ser. No. 570,628 filed Jan. 13, 1984, abandoned, which is a continuation-in-part of application Ser. No. 554,721, abandoned, filed Nov. 17, 1983, which is a continuation of application Ser. No. 458,993, abandoned, filed Jan. 18, 1983, which is a continuation-in-part of application Ser. No. 400,481, filed July 21, 1982, now U.S. Pat. No. 4,419,325, issued Dec. 6, 1983.

BACKGROUND OF THE INVENTION

This invention relates to grain-refined, gold free palladium-based dental alloys and, in particular, to grain-refined alloys for use in porcelain-fused-to-metal restorations.

Porcelain-fused-to-metal restorations consist of a metallic sub-structure coated with a veneer of porcelain. Over the years various alloys have been proposed for the sub-structure of these restorations. Many of the early alloys used gold with some platinum or palladium as the main alloy ingredients. However, with the increases and fluctuations in the price of gold and platinum in recent years, other alloys have come to play major roles in this area. One series of alloys which has gained general acceptance is based on nickel, chromium and beryllium as the main ingredients. Another series of alloys, with which this invention is concerned, is based on palladium as the dominant element.

Alloys suitability for use in porcelain-fused-to-metal restorations must satisfy a plurality of demanding conditions imposed both by the marketplace and by the physical and chemical requirements applicable to alloys for use in dental restorations. With regard to the marketplace demands, the alloy should have as low a price as possible. Specifically, it is important to avoid, if possible, the inclusion of gold in the alloy because of both the high price of this element and the essentially daily fluctuations in its price.

With regard to physical and chemical characteristics, the alloy should have a coefficient of thermal expansion such that the porcelain is under compression in the finished restoration. Further, during the porcelain firing process, the alloy must form a suitable protective oxide. Also, the alloy should have a high melting temperature so that castings made from the alloy will retain their shape during the porcelain firing process.

Of primary importance is the grain structure of the alloy. If the alloy has a good grain structure, it will have high elongation, tensile strength and toughness. These properties are important in avoiding "hot tearing" and in providing a casting with good burnishability.

SUMMARY OF THE INVENTION

In view of the above-described requirements regarding alloys for porcelain-fused-to-metal restorations, it is an object of the present invention to provide alloys which meet the physical and chemical requirements for such alloys and still have a low price. In particular, it is an object of the invention to provide palladium-based dental alloys which are grain-refined and gold-free, and which exhibit the properties of placing the porcelain under longitudinal compression in the finished restoration, being inert in a patient's mouth, forming a suitable oxide during torch melting and during the porcelain firing process, and having suitable strength, elongation and thermal expansion properties for use in porcelain-fused-to-metal restorations.

In accordance with the invention, grain-refined, palladium-based dental alloys are provided which consist essentially of approximately 70% to 85% by weight palladium, 7% to 15% by weight copper, 2% to 8% by weight gallium, 2% to 15% by weight indium, 0.2% to 3.0% by weight rhenium or ruthenium, and an effective amount of boron up to about 0.15% for the purpose of essentially eliminating the formation of bubbles in the porcelain during the porcelain firing process, the total of the constituents being 100%. In certain preferred embodiments, an effective amount of zinc up to about 0.5% is also added to the alloy for the purpose of further eliminating the formation of bubbles in the porcelain during the porcelain firing process. In other preferred embodiments, the boron is added in the form of calcium boride ($CaB_6$), in which case, the alloy will contain calcium boride in an amount ranging up to about 0.15%.

The rhenium and ruthenium in these alloys serve as grain refining agents. In accordance with the invention, to introduce these agents, the alloy must be made in a protective environment, such as, under vacuum or in a reducing or an inert atmosphere, e.g., an atmosphere of argon. If not done in this way, the alloy that is produced will contain absorbed gases which cause bubbling of the porcelain during the porcelain firing process.

In my application Ser. No. 554,721, it was shown that the use of a protective environment during the formation of the alloy and the incorporation of controlled amounts of boron or boron and calcium as part of the alloy essentially eliminate bubble formation during the porcelain firing process. For most conditions, levels of boron between about 0.03% and 0.10%, whether used alone or in combination with levels of calcium between about 0.02% and 0.07%, have been found sufficient to eliminate bubbling. These are desirable levels for boron and calcium since they result in alloys which have sufficient ductility to permit easy and inexpensive manufacturing of the alloy, i.e., a ductility which is high enough not to require intermittent annealing of the alloy during rolling the alloy into sheets. Under some conditions, however, e.g., overheating of the alloy during the casting process and/or multiple re-melts of the alloy, these levels for boron and calcium have been found to be insufficient to eliminate completely bubble formation during the porcelain firing process. Although higher levels of boron or boron plus calcium can be used to guarantee bubble-free restorations, even for overheated and re-melted alloys and the like, such higher levels result in an alloy which is too hard to be rolled without being intermittently annealed. The need for intermittent annealing steps in the manufacturing process obviously raises the cost of the alloy and is undesirable.

It has now been found that bubble-free restorations can be achieved with low levels of boron or boron plus calcium through the inclusion of small amounts of zinc in the alloy. Such zinc-containing alloys have hardness levels which permit rolling without prior annealing. Moreover, these alloys have been found to produce finished restorations which are essentially bubble-free for a wide range of processing conditions.

BRIEF DESCRIPTION OF THE DRAWINGS

In FIG. 1, the coefficient of expansion of the alloy is greater than that of the porcelain so that the porcelain is under longitudinal compression in the final fused product, as is desired. In contrast, FIG. 2 illustrates the undesirable situation where the porcelain is under longitudinal tension in the final fused product because the coefficient of thermal expansion of the alloy is less than the coefficient of thermal expansion of the porcelain. The changes in length shown in these figures are for purposes of illustration only, and are not to scale.

DESCRIPTION OF THE PREFERRED EMBODIMENTS

Figure 1:
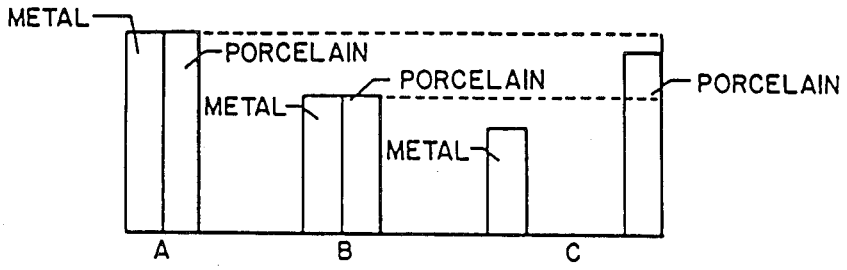
FIGS. 1 and 2 illustrate diagrammatically the importance of the relative coefficients of thermal expansion of the alloy and the porcelain.

The alloys of this invention can include the following constituents: palladium, copper, gallium, indium, rhenium or ruthenium, zinc, boron and calcium. Particularly preferred compositions for the alloy are shown in the following table, where the percentages given are by weight:

TABLE I

| Alloy | Pd | Cu | Ga | In | Re/Ru | Zn | $CaB_6$ |
|---|---|---|---|---|---|---|---|
| A | 78.75% | 10% | 7% | 4% | 0.2% Ru | — | 0.05% |
| B | 78.50% | 10% | 7% | 4% | 0.2% Ru | 0.25% | 0.05% |
| C | 78.75% | 9.75% | 7% | 4% | 0.2% Re | 0.25% | 0.05% |

Palladium gives the alloy its basic inertness so that it can withstand the environment of the patient's mouth. The palladium concentration of the alloy is preferably between about 70 and 85 wt. %, and most preferably between about 75 and 80 wt. %.

Boron or boron and calcium serve to protect the alloy during torch melting and during the porcelain firing process. Specifically, as the alloy is torch melted prior to being cast, the boron and calcium form oxides and other compounds and thus act as scavengers for the melt. As such, they help prevent the absorption of gases by the molten alloy. Such gases, if permitted to be absorbed, could later be released during the porcelain application process and thus form bubbles in the porcelain. Moreover, because of the presence of boron or boron and calcium, the melting characteristics of the alloys are similar to those of pure gold, which is considered desirable by dental laboratories.

Boron alone or a combination of boron and calcium, introduced as calcium boride ($CaB_6$), can be used as the scavenger. The concentration of boron can range up to about 0.15%, and is preferably between approximately 0.03 and 0.10% by weight, and most preferably about 0.05% by weight. When calcium boride is used, its concentration can range up to about 0.15% by weight, and is preferably between about 0.03% and 0.10% by weight, and most preferably about 0.05%.

Zinc functions as a further scavenger for the alloy and thus serves to further reduce bubble formation during the porcelain firing process. It has been found that small amounts of zinc, up to about 0.5% by weight, in combination with a protective environment and the use of boron or a combination of boron and calcium, protect the alloy during manufacture, torch melting, casting and the porcelain firing process, resulting in essentially complete elimination of bubbles in the finished restorations. Preferably between about 0.15 and 0.25 wt. % of zinc is included in the alloy, and most preferably about 0.25 wt. %.

As discussed above, inclusion of zinc in the alloy allows for the use of low levels of boron or boron and calcium so as to produce an alloy which (1) can be rolled without first being annealed and (2) produces finished restorations which are essentially bubble-free for a wide range of processing conditions. Also, the inclusion of zinc does not change the melting characteristics of the alloy so that it still melts like pure gold. Zinc preferably is not used as the sole scavenger for the alloy because at the levels required to prevent bubble formation during the porcelain firing process, zinc is unable to prevent the sputtering and spitting of the alloy during torch melting.

The amount of zinc must be controlled in view of the presence of gallium in the alloy. In particular, zinc cannot be used in large quantities (e.g., more than 0.5 wt. %) with gallium because of the formation of a low melting phase along grain boundaries which makes the alloy susceptible to tearing or fracture. Silicon, magnesium or mixtures thereof can be used to replace all or part of the zinc in the alloy. Of these three elements, zinc is considered the most preferred. When silicon is used in the alloy, its concentration is preferably kept below about 0.25%; when magnesium is used in the alloy, its concentration is preferably kept below about 0.50%.

Copper, gallium and indium reduce the alloy's melting point, strengthen it and form an adherent oxide on the surface of the casting which reacts with the porcelain to produce a chemical bond. These components also determine the coefficient of thermal expansion of the alloy.

The copper concentration is preferably between about 7 and about 15 wt. %, and most preferably between about 8 and about 10 wt. %. The gallium concentration is preferably between about 2 and about 8 wt. %, and most preferably between about 5 and about 7 wt. %. The indium concentration is preferably between about 2 and about 15 wt. %, and most preferably between about 3 and about 7 wt. %. These amounts of gallium, indium and copper provide a coefficient of thermal expansion which is compatible with the commercially available porcelains used in porcelain-fused-to-metal restorations.

Figure 2:
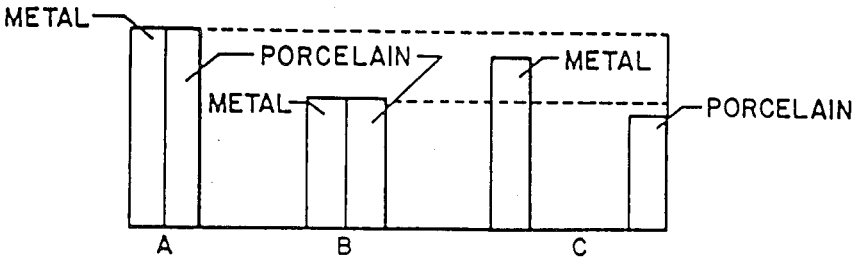

FIGS. 1 and 2 illustrate diagrammatically the importance of having the proper relative coefficients of thermal expansion for the porcelain and the alloy.

In FIG. 1, the metal is assumed to have a coefficient of expansion, and thus a coefficient of contraction, greater than that of the porcelain. Panel A of FIG. 1 shows the porcelain and alloy in their heated condition, just after the bond has formed between the porcelain and the oxides on the alloy. Panel B shows the porcelain and alloy, bonded together, in their cooled, contracted state. Panel C shows the contraction that would have occurred in the alloy and the porcelain if the two materials had not been bonded together.

Comparing panels B and C, we see that the metal component in panel C has a length shorter than the bonded porcelain-metal combination, while the porcelain component in panel C has a length greater than the bonded combination. Accordingly, for the bonded combination, the porcelain is under compression, because its length is less than the length it would have had if it had not been bonded to the alloy, while the alloy is under tension, because its length is greater than the length it would have had if it was not bonded to the porcelain.

FIG. 2 shows the identical set of conditions but for the coefficient of expansion of the metal being less than that of the porcelain. Again panel A shows the length of the alloy-porcelain combination in its heated condition. Panel B shows the length after cooling, and panel C shows the lengths the individual components would have had if they had not been bonded together. In this case, because the metal contracts less than the porcelain, the metal is under compression and the porcelain is under tension.

In terms of porcelain-fused-to-metal restorations, it is important that the porcelain be under compression, not tension. If it is under tension, cracks will form in the porcelain to relieve the tension.

Table II shows the thermal expansion behavior over the range from 300° C. to 700° C. of an alloy having the composition of alloy A in Table I.

TABLE II

| Temperature | % Expansion |
|---|---|
| 300° C. | 0.375 |
| 400° C. | 0.520 |
| 500° C. | 0.680 |
| 600° C. | 0.840 |
| 700° C. | 1.008 |

The percentage expansion data shown in this table was measured using a Theta differential dilatometer, where the reference temperature was 20° C., the rate of temperature climb was 5° C./minute and the reference standard was pure gold. The temperature expansion data reported in Table II are well within the range which will place the porcelain under compression when the alloy is used with commercially available porcelains employed in porcelain-fused-to-metal restorations. Essentially the same expansion data are observed when the alloy includes zinc in the amounts described above.

The rhenium or ruthenium component of the alloy provides the important property of grain refining. Alloys consist of individual grains in contact with each other. The size of these grains is critical to the physical properties of the alloy. This size can vary from coarse to fine, and the grains can be regular or irregular.

Ideally, a dental alloy should have fine, regular grains. Alloys with this type of grain structure exhibit superior elongation, tensile strength and toughness properties. Moreover, such alloys are less prone to hot tearing during the investment casting process, as compared to alloys with a coarser grain structure. "Hot tearing", as understood in the art, involves the formation of cracks in the casting due to stresses produced in the casting as it cools in the investment. These cracks can result in failures which necessitate remaking the casting with the concomitant loss of the time, energy and material used to make the original casting.

Figure 3:
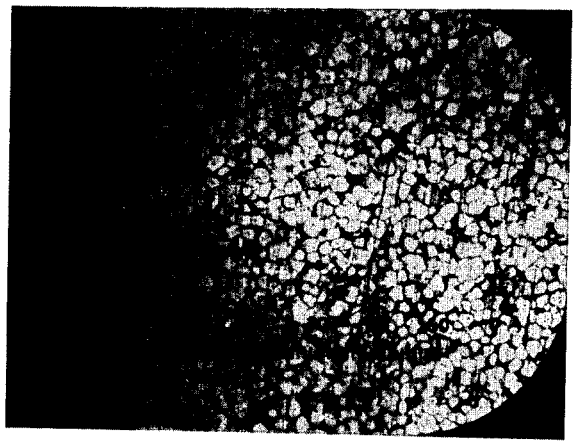
FIG. 3 is a photomicrograph showing the grain structure of an alloy of the present invention where ruthenium is used as a grain refining agent.

The alloys of the present invention use rhenium or ruthenium to grain refine the alloy. The use of ruthenium as the grain refining agent is preferred. FIG. 3 shows the grain structure of a finished alloy having the composition of alloy A in Table I. As can be seen from this photomicrograph, the grain structure is excellent and consists of regular, small grains. Essentially the same grain structure is achieved when the alloy includes small amounts of zinc.

Table III shows the physical properties characteristic of the grain-refined alloys of the present invention. An Instron machine was used to measure the values reported. The composition of the alloy was that of alloy A in Table I above.

TABLE III

| Yield Strength | Ultimate Tensile Strength | Elongation |
|---|---|---|
| 100,000 psi | 130,000 psi | 21% |

The physical properties reported in Table III, and in particular, the alloy's elongation, more than satisfy the physical requirements for an alloy for porcelain-fused-to-metal restorations. Essentially the same physical properties have been found in the presence of zinc.

As discussed above, grain-refining of the alloys of the present invention cannot be done in air, the standard technique, because to do so leads to the formation of bubbles in the porcelain during the porcelain firing process. Rather, the grain-refined alloy must be formed in a protective environment, such as, under vacuum, in a reducing atmosphere or in an inert atmosphere, for example, an atmosphere of argon. Without proceeding in this way, the alloy absorbs gases from the atmosphere which are later released from the alloy during firing to form bubbles in the porcelain. Also, it has been found that carbon containing crucibles are not advantgeous in the preparation of the alloys of the present invention. Rather, ceramic crucibles, e.g., zirconia crucibles, are preferred.

When argon is used as the protective environment, it is preferrably introduced after vacuum has been applied to the melting chamber to remove ambient air. Alternatively, a stream of argon can be passed through the chamber without first drawing a vacuum. When only a vacuum is used, the temperature of the melt and the applied vacuum must be controlled in view of the vapor pressures of the components of the alloy to avoid excessive relative losses of the more volatile components. In particular, when zinc is included in the alloy, a protective environment comprising a reducing or an inert gas, rather than a vacuum environment, should be used in forming the alloy in view of the relatively high vapor pressure of zinc.

In addition to the requirement that the grain refined alloy be made in a protective environment, the grain refining agent must be introduced within a specific range of concentrations. In particular, at least 0.2% of ruthenium or rhenium must be added to achieve the improved physical properties and additions above about 3.0% tend to embrittle the alloy. The preferred range for ruthenium or rhenium is between approximately 0.2 and 0.5 wt. %, the most preferred concentration being about 0.2 wt. %.

It should be noted that the improved grain and physical properties described above result whether the alloy is made in air or in a protective environment; it is only so that porcelain can later be applied to a casting made from the alloy that a protective environment has to be used in preparing the alloy.

Although specific embodiments of the invention have been described and illustrated, it is to be understood that modifications can be made without departing from the invention's spirit and scope. Thus the concentrations of palladium, copper, gallium, indium, ruthenium or rhenium, zinc, boron and calcium can be varied from the percentages illustrated and alloys having the superior characteristics of the invention will still result. For example, the palladium concentration can be varied at least between 70 and 85% by weight; the copper concentration between 7 and 15%; the gallium concentration between 2 and 8%; the indium concentration between 2 and 15%; the ruthenium or rhenium concentration between 0.2 and 3.0%; the zinc concentration up to 0.5%; the boron concentration up to 0.15%; and the calcium boride concentration up to 0.15%.

I claim:

1. A grain-refined, palladium-based dental alloy for porcelain-fused-to-metal restorations consisting essentially of, on a weight basis, about 70–85% palladium, 7–15% copper, 2–8% gallium, 2–15% indium, 0.2–3.0% ruthenium or rhenium, and an effective amount of boron up to about 0.15% and an effective amount of zinc up to about 0.5% for the purpose of essentially eliminating the formation of bubbles in the porcelain during the porcelain firing process, the total of the constituents being 100%.

2. The alloy of claim 1 wherein the ruthenium or rhenium concentration is between about 0.2 and 0.5%, the boron concentration is between about 0.03 and 0.10%, and the zinc concentration is between about 0.15 and 0.25%.

3. The alloy of claim 2 wherein the ruthenium or rhenium concentration is about 0.2%, the boron concentration is about 0.05%, and the zinc concentration is about 0.25%.

4. The alloy of claim 1 wherein all or part of the zinc is replaced by silicon, magnesium or mixtures thereof.

5. A grain-refined palladium based dental alloy for porcelain-fused-to-metal restorations consisting essentially of, on a weight basis, about 70–85% palladium, 7–15% copper, 2–8% gallium, 2–15% indium, 0.2–3.0% ruthenium or rhenium, an effective amount of calcium boride up to about 0.10% and an effective amount of zinc up to about 0.5% for the purpose of essentially eliminating the formation of bubbles in the porcelain during the porcelain firing process, the total of the constituents being 100%, wherein the components of the alloy are combined in a protective environment.

6. The alloy of claim 5 wherein the ruthenium or rhenium concentration is between about 0.2 and 0.5%, the calcium boride concentration is between about 0.03 and 0.10%, and the zinc concentration is between about 0.15 and 0.25%.

7. The alloy of claim 6 wherein the ruthenium or rhenium concentration is about 0.2%, the calcium boride concentration is about 0.05%, and the zinc concentration is about 0.25%.

8. The alloy of claim 5 wherein all or part of the zinc is replaced by silicon, magnesium or mixtures thereof.

9. The alloy of claim 7 wherein the palladium concentration is about 78.50%, the copper concentration is about 10%, the gallium concentration is about 7%, and the indium concentration is about 4%.

10. A grain-refined palladium based dental alloy for porcelain-fused-to-metal restorations consisting essentially of, on a weight basis, about 75–80% palladium, 8–10% copper, 5–7% gallium, 3–7% indium, 0.2–0.5% ruthenium or rhenium, and between about 0.03 and 0.10% boron and between about 0.15% and 0.25% zinc for the purpose of essentially eliminating the formation of bubbles in the porcelain during the procelain firing process, the total of the constitutents being 100.

11. The alloy of claim 10 wherein the concentration of ruthenium or rhenium is about 0.2%, the concentration of boron is about 0.05%, and the concentration of zinc is 0.25%.

12. A grain-refined palladium based dental alloy for porcelain-fused-to-metal restorations consisting essentially of, on a weight basis, about 75–80% palladium, 8–10% copper, 5–7% gallium, 3–7% indium, 0.2–0.5% ruthenium, an effective amount of calcium boride between about 0.03 and 0.10% and an effective amount of zinc between about 0.15% and 0.25% for the purpose of essentially eliminating the formation of bubbles in the porcelain during the porcelain firing process, wherein the components of the alloy are combined in a protective environment.

13. The alloy of claim 12 wherein the concentration of ruthenium or rhenium is about 0.2%, the concentration of calcium boride is about 0.05%, and the concentration of zinc is about 0.25%.

14. An essentially bubble-free, porcelain-fused-to-metal, dental restoration comprising procelain fused to a metallic alloy consisting essentially of, on a weight basis, about 70–85% palladium, 7–15% copper, 2–8% gallium, 2–15% indium, 0.2–3.0% ruthenium or rhenium, and an effective amount of boron up to about 0.15% and an effective amount of zinc up to about 0.5% for the purpose of essentially eliminating the formation of bubbles in the porcelain during the porcelain firing process, the total of the constituents being 100%.

15. An essentially bubble-free, porcelain-fused-to-metal, dental restoration comprising porcelain fused to a metallic alloy consisting essentially of, on a weight basis, about 70–85% palladium, 7–15% copper, 2–8% gallium, 2–15% indium, 0.2–3.0% ruthenium or rhenium, an effective amount of calcium boride up to about 0.10% and an effective amount of zinc up to about 0.5% for the purpose of essentially eliminating the formation of bubbles in the porcelain during the porcelain firing process, the total of the constituents being 100%, wherein the components of the alloy are combined in a protective environment.

16. The restoration of claim 15 wherein the palladium concentration is about 78.50%, the copper concentration is about 10%, the gallium concentration is about 7%, the indium concentration is about 4%, the ruthenium concentration is about 0.2%, the calcium boride concentration is about 0.05%, and the zinc concentration is about 0.25%.

* * * * *